US008043017B2

(12) United States Patent
Beierwaltes et al.

(10) Patent No.: US 8,043,017 B2
(45) Date of Patent: Oct. 25, 2011

(54) COSMETIC UNIT COMPRISING TWO COUPLED PARTIAL UNITS

(75) Inventors: Renate Beierwaltes, Burgoberbach (DE); Marion Reichert, Dorfkemmathen (DE); Sonja Schöppler, Dinkelsbühl (DE)

(73) Assignee: Geka Brush GmbH, Bechhofen (DE)

( * ) Notice: Subject to any disclaimer, the term of this patent is extended or adjusted under 35 U.S.C. 154(b) by 834 days.

(21) Appl. No.: 12/105,915

(22) Filed: Apr. 18, 2008

(65) Prior Publication Data

US 2008/0260449 A1 Oct. 23, 2008

(30) Foreign Application Priority Data

Apr. 19, 2007 (EP) ..... 07007931

(51) Int. Cl.

| | |
|---|---|
| ***B05C 1/00*** | (2006.01) |
| ***B43K 27/02*** | (2006.01) |
| ***A45D 40/24*** | (2006.01) |
| ***B65D 69/00*** | (2006.01) |

(52) U.S. Cl. ..... 401/17; 401/18; 132/314; 132/317; 132/294; 206/581

(58) Field of Classification Search ..... 401/17, 401/18; 132/294, 317, 314

See application file for complete search history.

(56) References Cited

U.S. PATENT DOCUMENTS

| | | | | |
|---|---|---|---|---|
| 3,690,777 | A | 9/1972 | Costa | |
| 6,035,865 | A * | 3/2000 | Krieger | 132/294 |
| 6,242,587 | B1 | 6/2001 | Naik et al. | |
| 6,682,242 | B1 | 1/2004 | Montoli | |
| 6,702,494 | B2 * | 3/2004 | Dumler et al. | 401/17 |
| 2002/0018688 | A1 | 2/2002 | Dumler et al. | |

FOREIGN PATENT DOCUMENTS

| | | |
|---|---|---|
| DE | 2037409 | 2/1972 |
| DE | 2123143 | 2/1972 |
| DE | 10039490 A1 | 8/2000 |
| EP | 1348352 B1 | 10/2003 |

* cited by examiner

*Primary Examiner* — David J. Walczak
*Assistant Examiner* — Bradley Oliver
(74) *Attorney, Agent, or Firm* — Browdy and Neimark, PLLC

(57) ABSTRACT

The cosmetic unit has two partial units, each including a receptacle for receiving a cosmetic substance and a closure cap for allowing the closure of the receptacle. The two partial units are inter-connectable by a coupling member engaging with the two closure caps. Each closure cap has a cap recess, extending in the direction of a central axis, on the axial front end facing away from the receptacle of the corresponding partial unit. The coupling member including a central portion with two axial coupling projections being formed thereon wherein each coupling projection engages with one of the two cap recesses when in an assembled state.

13 Claims, 4 Drawing Sheets

COSMETIC UNIT COMPRISING TWO COUPLED PARTIAL UNITS

BACKGROUND OF THE INVENTION

1. Field of the Invention

The invention relates to a cosmetic unit comprising two partial units of which each comprises a receptacle for receiving a cosmetic substance and a closure cap by means of which the receptacle is closable, the two partial units being interconnectable by means of a coupling member engaging with the two closure caps wherein each closure cap has a cap recess that is disposed on an axial front end facing away from the receptacle of the respective partial unit and extends in the direction of a central axis.

2. Background Art

Such a cosmetic unit is for example known from EP 1 348 352 B1. The two screw-top receptacles may be filled with the same or different cosmetics, such as nail polish, mascara, eye shadow, lip gloss or products for removing the same. The known cosmetic unit comprises an axial serration as well as additional beaded sections engaging with locking grooves for releasably securing the closure cap to the coupling member designed as a coupling sleeve. The serration ensures a non-rotational connection while the beaded sections engaging with the locking grooves provide for a tight axial connection. Thus, two different connection mechanisms are provided that act independently of one another. This results in a relatively high effort of production.

The same applies to the production of the closure caps that are overlapped by the coupling sleeve and must therefore be provided with a comparatively small external diameter in this area. At the same time, however, the connection between the closure cap and the respective applicator wand is also disposed in this same area, with the result that there is only a small amount of space available for the wall thickness of the closure caps. The manufacture thereof must therefore be carried out in a very precise manner.

The coupling sleeve may for example have a particular graphic design or a specific colour, enabling a different contents of the two partial units as well as the different applications thereof to be identified from the outside of the cosmetic unit according to EP 1 348 352 B1. Consequently, a differently designed coupling sleeve must be provided for any possible combination of contents. This multitude of different coupling sleeves also results in higher production costs.

The cosmetic unit according to EP 1 348 352 B1 has a pleasant appearance, especially when the coupling sleeve is attached. If, however, the coupling sleeve is removed, thereby revealing the outer contour of the closure cap that is defined by the described connection mechanisms, this is only true to a limited extent.

SUMMARY OF THE INVENTION

Thus it is the object of the invention to provide a cosmetic unit of the above-described type wherein the two partial units are inter-connectable in a simple manner whilst in particular requiring a low effort of production.

This object is attained by a cosmetic unit comprising two partial units, each of which having a receptacle for receiving a cosmetic substance and a closure cap by means of which the receptacle is closable, wherein the two partial units are interconnectable by means of a coupling member that engages with the two closure caps, and wherein each closure cap has a cap recess, extending in a direction of a central axis, on an axial front end that faces away from the receptacle of the corresponding partial unit.

The coupling member of the cosmetic unit according to the invention comprises a central portion having two axial coupling projections being formed thereon, each of the coupling projections engaging with one of the two cap recesses when in the assembled state. The connection mechanism provided according to the invention, i.e. the coupling projection engaging with the cap recess, is both easy to implement and to produce whilst providing a tight connection between the coupling member and the respective closure cap.

Moreover, the cosmetic unit according to the invention provides for a simple and cost-effective means of marking the contents of each partial unit without requiring a large number of different coupling members. Marking may be carried out by means of a corresponding graphic design or a specific colour of the closure caps. Owing to the connection mechanism provided according to the invention, the closure caps are also visible in particular in the assembled state and may therefore be used for marking the contents of the respective partial unit. Moreover, the outer circumferential surfaces of the closure caps that are visible in the assembled state may be designed according to the individual aesthetic requirements. Advantageously, they fulfil no function with respect to the connection mechanism. Thus, the closure caps of the cosmetic unit according to the invention may in particular have visually pleasing smooth and/or shiny outer circumferential surfaces.

A favourable embodiment has a longitudinal hollow space that extends in the axial direction and is provided in the coupling projection of the coupling member. Moreover, a transverse hollow space extending perpendicularly to the axial direction may advantageously be provided in the coupling projection. These hollow spaces increase the elasticity of the coupling projection which may therefore be more easily inserted into the cap recess. Moreover, this leads to an improved contact pressure of the inserted coupling projection against the internal wall of the cap recess.

In a favourable embodiment, an internal wall of the cap recesses is provided with a locking protrusion that engages with the transverse hollow space when in the assembled state. This allows for a very simple formation of a snap-in connection between the coupling member and the respective closure cap that is releasable, if required. Moreover, another advantage of a releasable connection is that it is not only the industrial manufacturer and/or the filler of the partial units who is capable of joining the partial units to form the double-element cosmetic unit. This may also be carried out later-on in the stores or even by the end user herself.

Moreover, an adhesive bond may advantageously be provided between the coupling projection and the closure cap, thus forming a connection between the coupling member and the respective closure cap that is in particular no longer releasable. On the one hand, the longitudinal and transverse hollow spaces that are in particular provided in the coupling projections may then serve as initial reservoirs for an adhesive which passes from the reservoir into the space defined by the opposite wall areas of the respective coupling projection and the respective closure cap when in the assembled state. On the other hand, the above hollow spaces may also serve as reservoirs for an excess adhesive which is filled into the cap recess prior to assembly.

According to another advantageous embodiment, the coupling projection is disposed within the cap recess by means of a press-fit when in the assembled state, thus allowing to form a releasable connection between the coupling member and the respective closure cap.

Moreover, the coupling projection has in particular an angled, rounded, oval or round cross-section. A round cross-section facilitates the assembly of the coupling member and the respective closure cap since there is no preferential direction that must be observed. The other types of cross-section stated above, on the other hand, do not have a perfect rotational symmetry. They enable a particularly non-rotational connection to be obtained between the coupling member and the respective closure cap. This is of particular advantage when the closure cap is screwed to the receptacle. When the closure cap is screwed on or removed from the receptacle, respectively, the connection between the coupling member and the closure caps is preserved.

Moreover, the coupling member has in particular an angled, rounded or oval cross-section in transition areas from the central portion to the respective coupling projection. Although such a cross-section is in particular only provided in the transition area, this enables a non-rotational connection to be formed between the coupling member and the respective closure cap.

According to another favourable embodiment, an area of cross-sectional surfaces in the transition areas steadily decreases from the central portion, an outer contour extending in the direction of the central axis advantageously describing a curve in the transition area, said curve being in particular defined by a longitudinal radius. This facilitates the assembly of the coupling member and the partial units. Moreover, the rounded design is aesthetically pleasing.

In another advantageous embodiment, each of the coupling projections has at least one transverse slot at the free end thereof, said slot extending perpendicularly to the axial direction and over the entire transverse dimension. In particular, there may be provided two or four of such transverse slots which are then advantageously disposed along the cross-section in an evenly distributed manner. This improves the elasticity of the coupling projections, which is of particular advantage for snap-in connections with the closure caps.

Moreover, it is favourable for each of the coupling projections to be provided with at least two webs at the free end thereof that are separated by the transverse slot wherein a locking protrusion is provided on an outside of at least one web. This provides a particularly simple means of establishing a snap-in connection with the closure caps. The locking protrusion snaps into a corresponding recessed locking portion disposed in the respective cap recess.

According to another advantageous embodiment, the central portion has two axial front ends and an outer circumferential surface wherein one circumferential rounded edge is provided between each of the front ends and the outer circumferential surface. Thus, smooth, pleasant-to-touch contours are obtained in the contact area between the closure caps and the central portion whilst avoiding a sharp edge that may cause injuries. Moreover, the rounded design is aesthetically pleasing.

In another, equally advantageous embodiment, the central portion has two axial front ends and an outer circumferential surface wherein one circumferential edge is provided between each of the front ends and the outer circumferential surface, said edge having an axially protruding edge projection, thereby providing for virtually seamless and gap-free contact areas between each of the closure caps and the central portion.

Further features, advantages and details of the invention will become apparent from the ensuing description of embodiments, taken in conjunction with the drawings.

BRIEF DESCRIPTION OF THE DRAWINGS

Corresponding parts are referred to with the same reference numerals in FIGS. 1 to 13.

DESCRIPTION OF THE PREFERRED EMBODIMENTS

Figure 1:
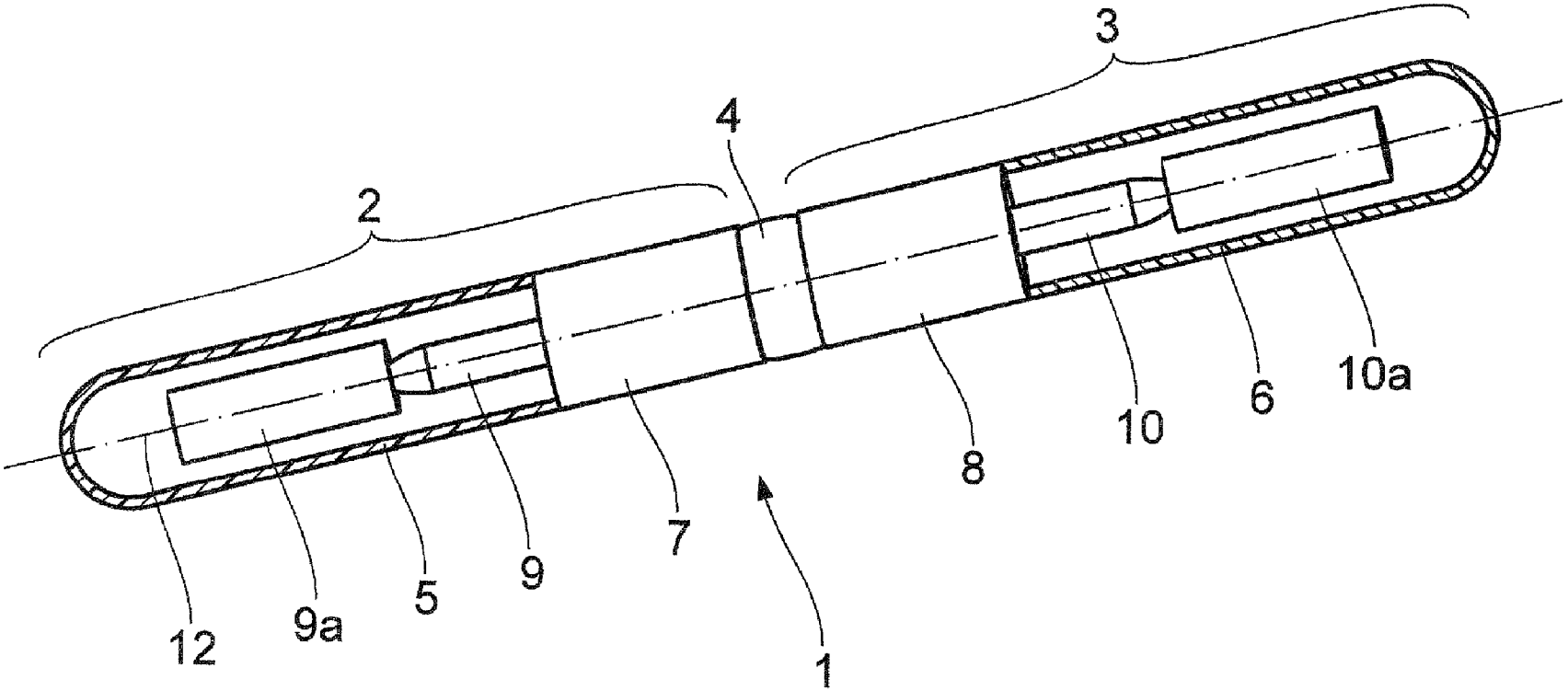
FIG. 1 shows an embodiment of a cosmetic unit comprising two partial units joined together by means of a coupling member.

FIG. 1 shows an embodiment of a cosmetic unit 1 made of plastics. Said cosmetic unit 1 comprises two partial units 2 and 3 that are joined together by means of a coupling member 4. In the embodiment according to FIG. 1, this connection is releasable; basically, however, it is also conceivable to provide another type of connection, such as an adhesive bond.

Each of the partial units 2 and 3 includes a receptacle 5 or 6, respectively, that may be tightly sealed by means of a closure cap 7 or 8, respectively, which may be screwed thereon, for example. Each of the receptacles 5 and 6 contains a cosmetic substance into which a wand 9 or 10, respectively, immerses that is formed on the respective closure cap 7 or 8. The cosmetics filled into the receptacles 5 and 6 may differ from one another. In this embodiment, the partial unit 2 is filled with a mascara liquid while the partial unit 3 is filled with a nail polish. Only schematically indicated in FIG. 1, an applicator 9*a* or 10*a*, respectively, such as a brush for mascara or nail polish, respectively, is attached to the immersed wand end.

Figure 2:
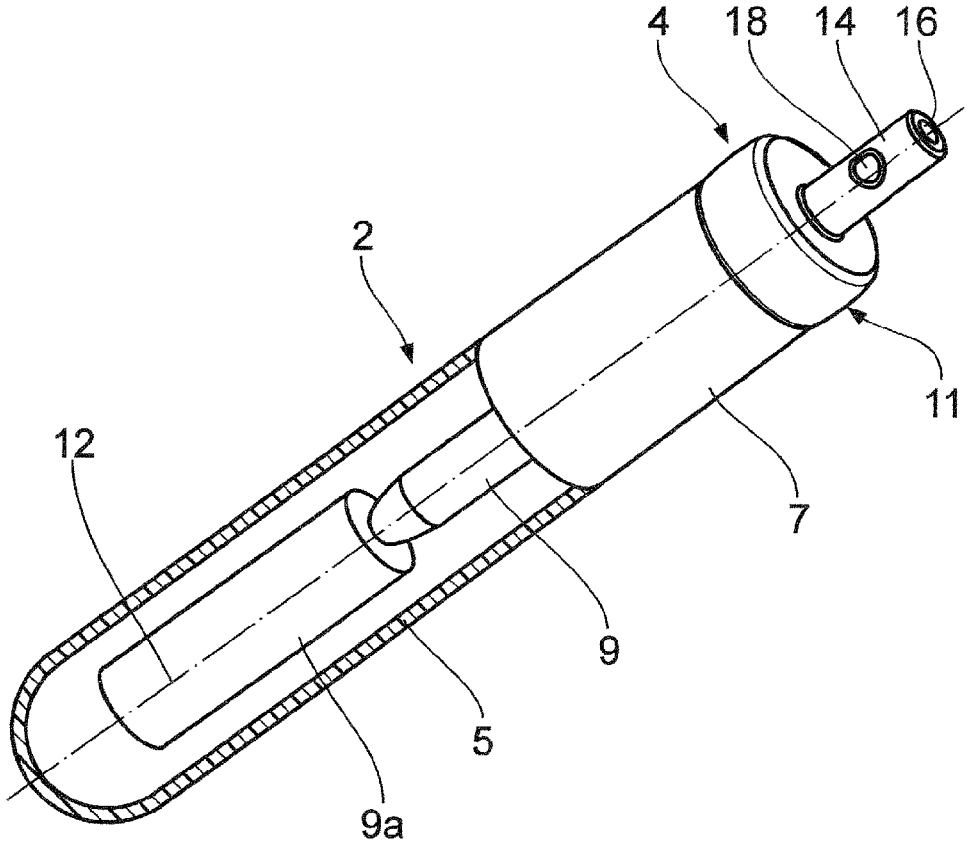
FIG. 2 shows a partial unit of the cosmetic unit according to FIG. 1 with the coupling member inserted.
Figure 3:
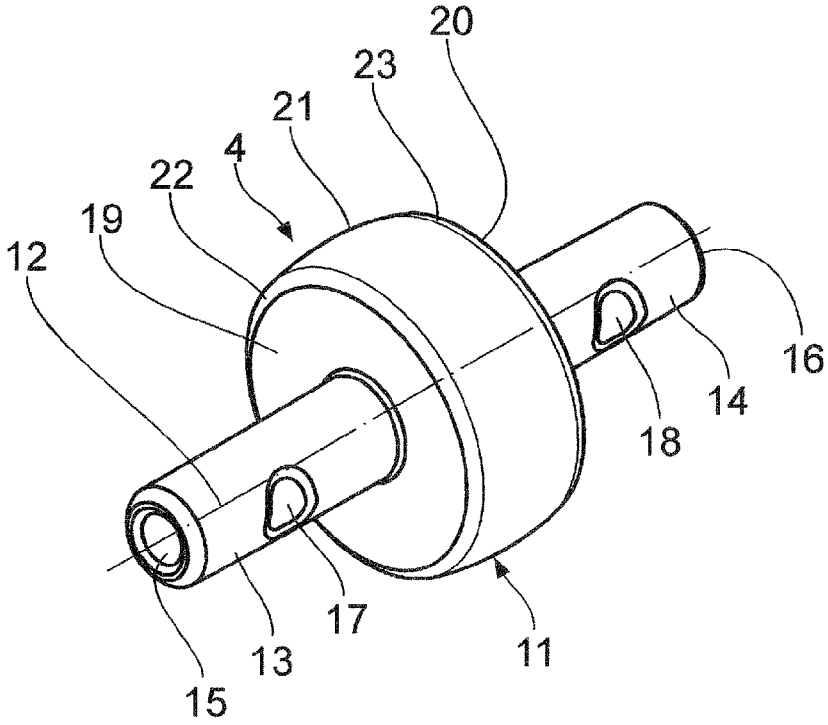
FIG. 3 shows the coupling member of the cosmetic unit according to FIG. 1.

FIG. 2 shows the cosmetic unit 1 in an only partially assembled state while FIG. 3 shows the un-mounted coupling member 4. The coupling member 4 has a cylindrical central portion 11 comprising two axial coupling projections 13, 14 that show in the direction of a central axis 12 of the cosmetic unit 1. Said coupling projections 13, 14 are concentric with the central axis 12 and are formed on a respective one of the two axial front ends each of the central portion 11, thereby forming studs.

Correspondingly, on their axial front end facing away from the respective receptacle 5 or 6, the closure caps 7 and 8 have a cap recess that is not shown in detail in FIGS. 1 to 3 and extends in the axial direction. When in the assembled state, the coupling projections 13 and 14 engage with one of these cap recesses.

The cross-sectional contours of the cap recess and the coupling projections 13 and 14 are adapted to one another. They are substantially equal. However, when not inserted, the coupling projections 13 and 14 have a slightly larger cross-sectional surface than the cap recesses so as to obtain a tightly connected press-fit when in the inserted state.

Each of the coupling projections 13 and 14 has a concentric hollow space 15 or 16, respectively, that extends from the free axial front end of the respective coupling projection 13 or 14 into the respective coupling projection 13 or 14 in the axial direction. Said hollow spaces 15 and 16 may be blind holes or through-holes penetrating through the entire coupling member 4. The longitudinal hollow spaces 15 and 16 increase the elasticity of the coupling projections 13 and 14, thereby making it easier for the latter to be inserted into the cap recesses. Additionally, this increased elasticity allows for the above described, slightly larger cross-sectional surface of the coupling projections 13 and 14 which advantageously results in a very high contact pressure against the internal wall of the cap recesses.

Moreover, each coupling projection 13 or 14 has a transverse hollow space 17 or 18, respectively, that runs perpendicularly to the central axis 12 and through the respective coupling projection 13 or 14. The length of these transverse hollow spaces 17 and 18, which are round through-holes in this embodiment, equals the diameter of the coupling projections 13 and 14. The longitudinal hollow spaces 15 or 16, respectively, and the transverse hollow spaces 17 or 18, respectively, intersect and are connected to one another. Corresponding partially spherical locking protrusions are provided on the otherwise hollow-cylindrical internal walls of the cap recesses, said locking protrusions snapping into the transverse hollow spaces 17 and 18 when the cosmetic unit 1 is in the assembled state, thereby increasing the strength of the connection both in the axial as well as in the tangential direction.

The coupling member 4 is mirror-symmetric with respect to a cross-sectional plane that extends along the axial centre of the central portion 11 right through the central portion 11. Furthermore, apart from the transverse hollow spaces 17 and 18, said coupling member 4 is rotation-symmetric with respect to the central axis 12.

Moreover, the outer contour of the central portion 11 is adapted to an outer contour of the closure caps 7 and 8, or of the partial units 2 and 3 as a whole, respectively. In the embodiment, each of the partial units 2 and 3 as well as the central portion 11 has a substantially cylindrical outer circumferential surface with approximately the same cylinder radius. This results in an aesthetically pleasing design whilst providing for an easy handling. Visible and touchable in the assembled state, the central portion 11 of the coupling member 4 is pleasant to the eye and to the touch, and therefore blends perfectly with the cosmetic unit 1.

The same effects are obtained by another advantageous design measure carried out on the central portion 11. The central portion 11 has two axial front ends 19 and 20, an outer circumferential surface 21 extending therebetween. A rounded portion is provided on each of the two circumferential edges formed between each of the front ends 19 and 20 on the one hand and the circumferential surface 21 on the other hand, thereby providing a circumferential rounded edge 22 or 23, respectively, on either side. Therefore, when in the assembled state, the cosmetic unit 1 has a particularly smooth surface that is pleasant to the touch, having no sharp transition zones between the partial units 2 and 3 and the central portion 11 of the coupling member 4 that are likely to cause injuries.

The above described, favourable design of the cosmetic unit 1 comprising the coupling member 4 enables the manufacturer to fill and handle the receptacles 5 and 6 separately and independently of one another by means of conventional machines. The closure caps 7 and 8 are also screwed on by means of available machines in the manner of conventional screw caps. The partial units 2 and 3 thus produced are storable and transportable independently of one another. They may be assembled into the cosmetic unit 1 whenever desired. This may be done by the manufacturer, or even by the vendor himself, responding to individual customer requests. All that is required in order to do so is to plug both partial units 2 and 3 to the common coupling member 4 axially from both sides.

Together with the closure cap 8 or 7, respectively, that is rigidly (and/or non-rotationally) connected via the coupling member 4, the partial unit 2 or 3, respectively, that is not used at a particular time may be removed from the receptacle 6 or 5, respectively, containing the cosmetic substance to be used, thereby serving as a kind of handle which provides for a particularly easy handling.

If one of the receptacles 5 and 6 is empty, it is not necessary to dispose of the entire cosmetic unit 1 since the empty partial unit 2 or 3 may be replaced by a new one. All that is required in order to do so is to release the plug connection in the vicinity of the coupling member 4. The still usable, completely or partially filled partial unit 3 or 2 may then be combined with another partial unit 2 or 3, thereby either restoring the original combination of the cosmetic unit 1 or creating a new combination according to the individual customer request.

The other embodiments of coupling members shown in FIGS. 4 to 12, which may also be used to form double cosmetic units comparable to the cosmetic unit 1 that is releasably assembled from the partial units 2 and 3, substantially have the same advantageous effects as the above described coupling member 4 of the cosmetic unit 1.

Figure 4:
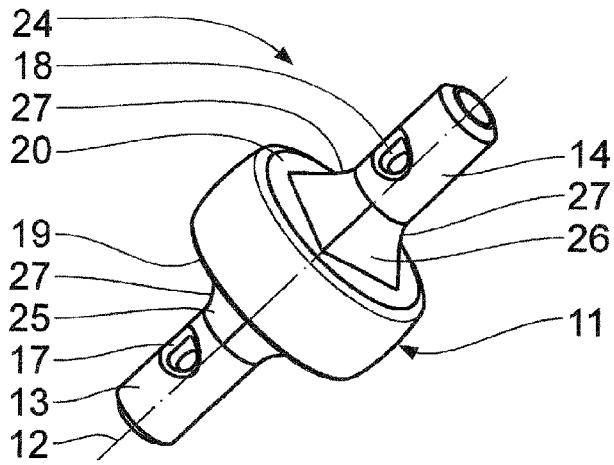
FIGS. 4 and 5 show a perspective or lateral view, respectively, of an embodiment of a coupling member for a cosmetic unit comprising two inter-connectable partial units.
Figure 5:
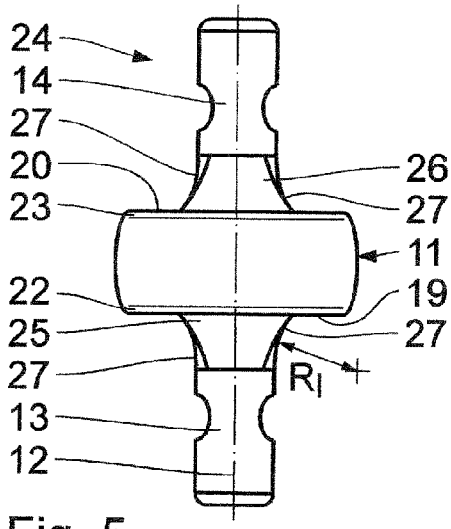

FIGS. 4 and 5 show a coupling member 24 that differs from the coupling member 4 according to FIGS. 1 to 3 essentially by transition areas 25 and 26 which are additionally provided between the central portion 11 and the respective coupling projection 13 or 14, respectively. Each of the transition areas 25 and 26 has an angled cross-sectional surface, the area thereof steadily decreasing from the front ends 19 or 20, respectively, of the central portion, and the shape thereof finally tapering into the round cross-sectional geometry that is provided in the end area of the respective coupling projection 13 or 14 facing towards the free end thereof. The four edges 27 (also refer to FIG. 11) that are formed in each of the transition areas 25 and 26 due to the angled cross-section thereof extend in the axial direction in a convexly curved manner. This curved contour of the edges 27 is defined by a longitudinal radius $R_1$. The transition areas 25 and 26 correspond to correspondingly formed cross-sectional contours in the cap recesses of the two partial units not shown in FIGS. 4 and 5 which may be assembled into a double cosmetic unit by means of the coupling member 24. The angled cross-sectional contour in the transition areas 25 and 26 then results in a non-rotational connection between the coupling member 24 and the respective closure cap of the two partial units.

Figure 6:
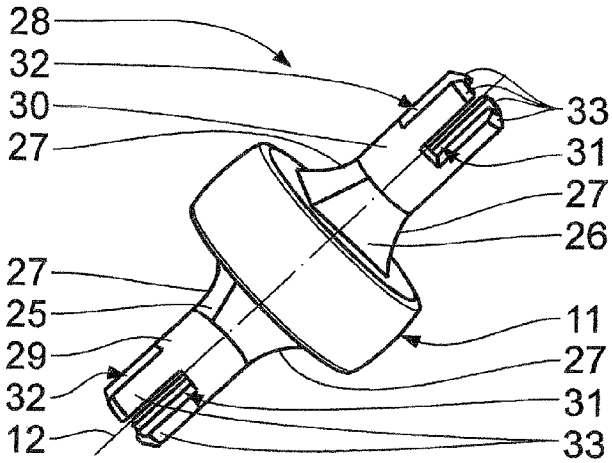
FIGS. 6 and 7 show a perspective or lateral view, respectively, of an embodiment of a coupling member for a cosmetic unit with two inter-connectable partial units.
Figure 7:
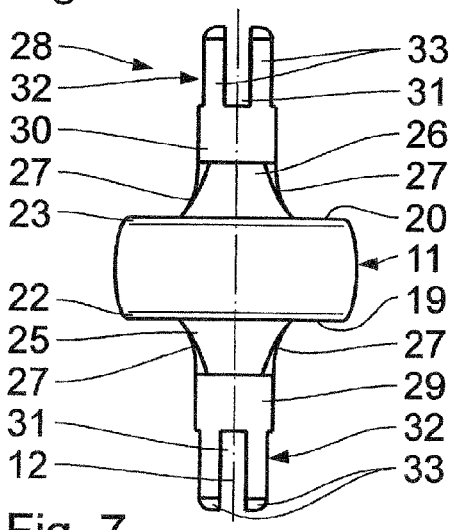

FIGS. 6 and 7 show another coupling member 28 which, compared to the coupling member 24 according to FIGS. 4 and 5, is provided with differently designed coupling projections 29 and 30. Instead of the longitudinal hollow spaces 15 and 16 as well as the transverse hollow spaces 17 and 18, the coupling projections 29 and 30 of the coupling member 28 have two transverse slots 31 and 32 on the respective free end thereof that extend perpendicularly to the direction of the central axis 12. Said transverse slots 31 and 32 extend over the entire transverse dimension, i.e. over the entire length of the diameter of the coupling projection 29 or 30. They are disposed in a vertical row so as to form four material webs 33 on each free end of the coupling projection 29 or 30 that have the same size and are evenly distributed in the circumferential direction. The transverse slots 31 and 32 separate the material webs 33 from one another. Similarly to the longitudinal hollow spaces 15 and 16 of the coupling projections 13 and 14, the transverse slots 31 and 32 also increase the elasticity of the coupling projections 29 and 30, thereby facilitating the insertion of the latter into the cap recesses.

Figure 8:
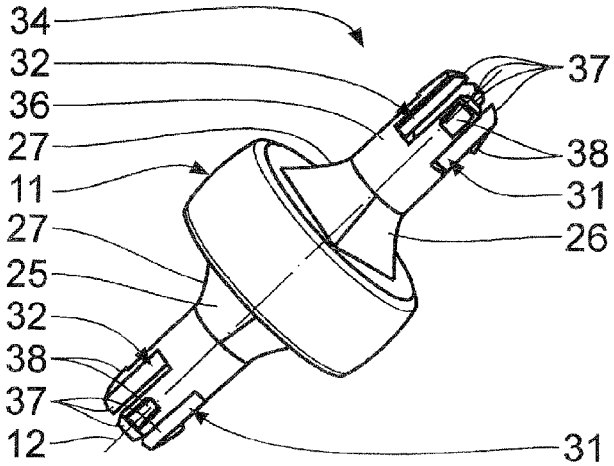
FIGS. 8 and 9 show a perspective or lateral view, respectively of an embodiment of a coupling member for a cosmetic unit with two inter-connectable partial units.
Figure 9:
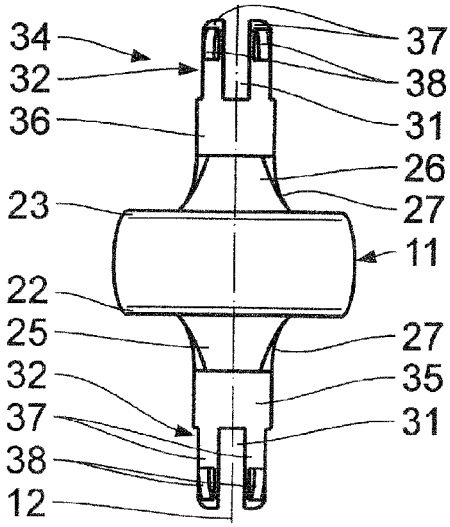

FIGS. 8 and 9 show another coupling member 34 comprising the central portion 11 and the coupling projections 35 and 36. Similarly to the coupling projections 29 and 30, each of the coupling projections 35 and 36 has four material webs 37 at the free end thereof that are separated by the transverse slots 31 and 32. In contrast to the material webs 33, the material webs 37 are provided with a locking protrusion 38 at the respective outside thereof. In the assembled state of a cosmetic unit that is not shown in detail in FIGS. 8 and 9, the locking protrusions 38 engage with corresponding recesses at the internal walls of the cap recesses, thereby forming a snap-in connection which is releasable due to the elasticity of the material webs 37.

Figure 10:
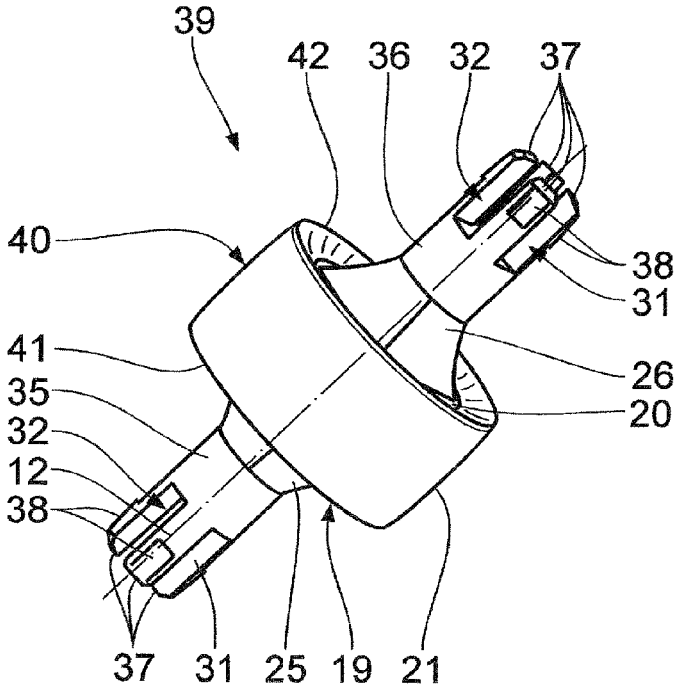
FIGS. 10 and 11 show a perspective or axial plan view, respectively of an embodiment of a coupling member for a cosmetic unit with two inter-connectable partial units.
Figure 11:
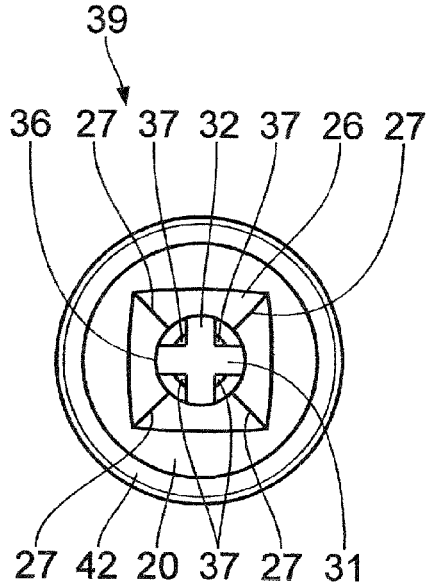

FIGS. 10 and 11 show another coupling member 39 which is substantially similar to that of the coupling member 34 but has a differently designed central portion 40 which is different from all coupling members 4, 24, 28 and 34. Instead of the circumferential rounded edges 22 and 23 extending along the contact areas between the front ends 19 and 20 and the outer circumferential surface 21, the central portion 40 has a circumferential edge which comprises an axially protruding edge projection 41 or 42, respectively, and is disposed in each of these areas. In the assembled state of a cosmetic unit again not shown in detail in FIGS. 10 and 11, the edge projections 41 and 42 overlap with the outer circumferential edge at the axial end of the closure caps, thereby providing contact areas between the each of the closure caps and the central portion 40 that are virtually seamless and gap-free.

Figure 12:
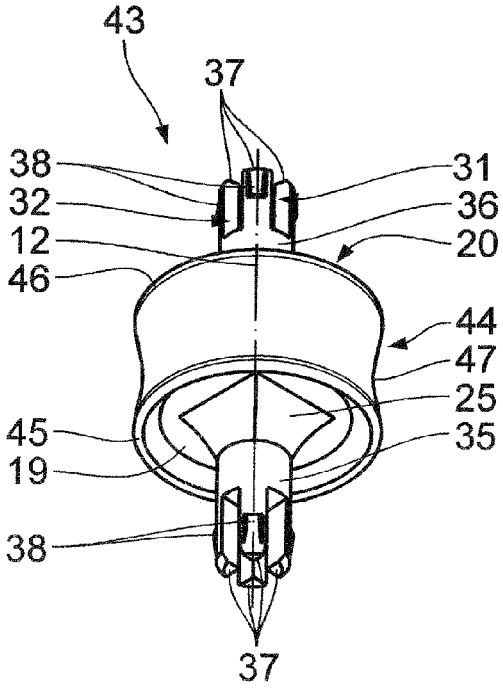
FIGS. 12 and 13 show a perspective or lateral view, respectively, of an embodiment of a coupling member for a cosmetic unit with two inter-connectable partial units.
Figure 13:
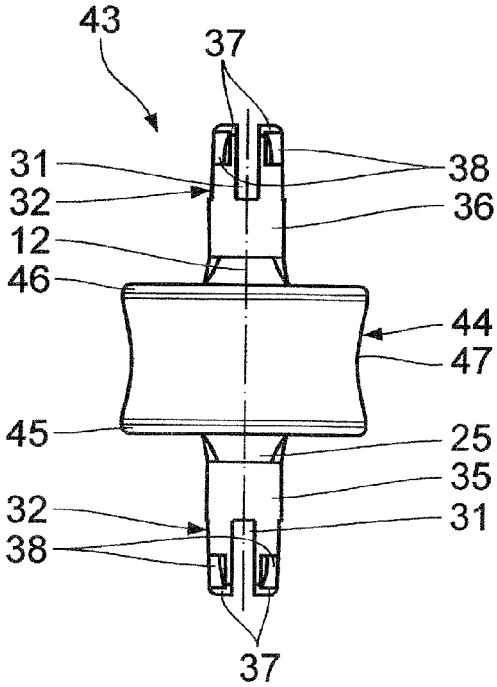

FIGS. 12 and 13 show another coupling member 43 that has a central portion 44 comprising circumferential edge projections 45 and 46 that extend axially along the front ends 19 or 20, respectively, in the direction of the respective coupling projection 35 or 36, respectively, in a manner similar to the edge projections 41 and 42 of the central portion 40 of the coupling member 39 according to FIGS. 10 and 11, thereby also allowing for a seamless and gap-free assembly to be obtained with the closure caps. In contrast to the outer circumferential surface 21 of the central portions 11 and 40 that has a slightly convex curve in the radial direction, the central portion 44 has an outer circumferential surface 47 with a concave curve.

What is claimed is:

1. A cosmetic unit comprising:

two partial units, each of which having a receptacle for receiving a cosmetic substance and a closure cap by which the receptacle is closable, a coupling member that engages with the two closure caps, whereby the two partial units are interconnectable, and a cap recess defined in each closure cap, extending in a direction of a central axis, on an axial front end that faces away from the receptacle of the corresponding partial unit, wherein the coupling member comprises a central portion with two axial coupling projections being formed thereon, wherein each coupling projection engages with one of the two cap recesses when in an assembled state, and wherein a longitudinal hollow space that extends in an axial direction is provided in the two axial coupling projections of the coupling member.

2. A cosmetic unit according to claim 1, wherein a transverse hollow space that extends perpendicularly to the axial direction is provided in the two axial coupling projections of the coupling member.

3. A cosmetic unit according to claim 2, wherein an internal wall of the cap recesses is provided with a locking protrusion which engages with the transverse hollow space when in the assembled state.

4. A cosmetic unit according to claim 1, wherein an adhesive bond is provided between the two axial coupling projections and the closure cap.

5. A cosmetic unit according to claim 1, wherein the two axial coupling projections are disposed within the cap recess by a press-fit when in the assembled state.

6. A cosmetic unit according to claim 1, wherein a cross-section of the two axial coupling projections has one of the following shapes:

angled;

rounded;

oval;

round.

7. A cosmetic unit according to claim 1, wherein a cross-section of the coupling member in transition areas from the central portion to one of the respective coupling projections has one of the following shapes:

angled;

rounded;

oval.

8. A cosmetic unit according to claim 7, wherein an area of cross-sectional surfaces in the transition areas steadily decreases from the central portion, and wherein an outer contour, which extends in the direction of the central axis, advantageously has a curved shape.

9. A cosmetic unit according to claim 8, wherein the curved shape of the outer contour, which extends in the direction of the central axis, is defined by a longitudinal radius.

10. A cosmetic unit according to claim 1, wherein each of the coupling projections has at least one transverse slot at the free end thereof that extends perpendicularly to the axial direction and over the entire transverse dimension.

11. A cosmetic unit according to claim 10, wherein each of the coupling projections has at least two webs at the free end thereof which are separated by the transverse slot, and wherein a locking protrusion is provided on the outside of at least one web.

12. A cosmetic unit according to claim 1, wherein the central portion has two axial front ends and one outer circumferential surface, and wherein one circumferential rounded edge each is provided between each of the front ends and the outer circumferential surface.

13. A cosmetic unit according to claim 1, wherein the central portion has two axial front ends and one outer circumferential surface, and wherein one circumferential edge each is provided between each of the front ends and the outer circumferential surface, said circumferential edge being provided with an axially protruding edge projection.

* * * * *